United States Patent [19]

Abe et al.

[11] 4,433,050

[45] Feb. 21, 1984

[54] DIRECT POSITIVE TYPE LIGHT SENSITIVE SILVER HALIDE PHOTOGRAPHIC MATERIAL

[75] Inventors: Takao Abe; Satoru Hohnishi, both of Hino, Japan

[73] Assignee: Konishiroku Photo Ind. Co., Ltd., Tokyo, Japan

[21] Appl. No.: 300,644

[22] Filed: Sep. 9, 1981

[30] Foreign Application Priority Data

Sep. 11, 1980 [JP] Japan ..... 55-126859
Sep. 11, 1980 [JP] Japan ..... 55-126860

[51] Int. Cl.[3] ..... G03C 1/02

[52] U.S. Cl. ..... 430/542; 430/940; 430/598; 430/564; 430/599; 430/567; 430/543; 430/559; 430/547; 430/552; 430/554; 430/556; 430/212; 430/217; 430/223; 430/226

[58] Field of Search ..... 430/940, 598, 564, 599, 430/567, 542, 543, 559, 547, 552, 554, 556, 212, 217, 223, 226

[56] References Cited

U.S. PATENT DOCUMENTS

| | | | |
|---|---|---|---|
| 3,178,282 | 4/1965 | Luckey et al. | 430/564 |
| 3,600,180 | 8/1971 | Judd et al. | 430/940 |
| 3,772,030 | 11/1973 | Gilman et al. | 430/940 |
| 4,035,185 | 7/1977 | Evans et al. | 430/940 |

*Primary Examiner*—Won H. Louie, Jr.
*Attorney, Agent, or Firm*—Frishauf, Holtz, Goodman & Woodward

[57] ABSTRACT

A direct positive type light sensitive silver halide photographic material is disclosed. At least one layer containing an unfogged internal latent image type silver halide emulsion, is provided on a support, and an internal latent image type silver halide emulsion having fog centers in silver halide grains, is incorporated in said layer or in another constituent layer of the photographic material. A dye image forming substance may be incorporated in the same layer or in a separate layer to form a color diffusion transfer type light sensitive photograhic material. The photographic materials present a positive image having a high maximum density and a low minimum density.

39 Claims, No Drawings

DIRECT POSITIVE TYPE LIGHT SENSITIVE SILVER HALIDE PHOTOGRAPHIC MATERIAL

BACKGROUND OF THE INVENTION

1. Field of the Invention

The present invention relates to a direct positive type light sensitive silver halide photographic material and a colour diffusion transfer type light sensitive photographic material. Particularly, the present invention relates to such photographic materials, in which a direct positive type light sensitive silver halide emulsion is used which is capable of forming a positive image having a high maximum density and a low minimum density.

2. Description of the Prior Art

There have hitherto been known various direct positive type light sensitive silver halide photographic materials. In a case of a photographic material in which an unfogged internal latent image type silver halide emulsion is used, a positive image is formed by carrying out surface development after or during the fogging treatment following image exposure. In such a case, the fogging treatment may be carried out by a suitable method selected from a method of exposing the entire surface, a method of using a foggant, a method of using a strong developing solution and a method by means of heat treatment.

These techniques are known from various literatures, for instance, from the disclosures in U.S. Pat. Nos. 2,592,250, 2,456,953, 2,497,875 and 2,588,982, U.K. Pat. No. 1,151,363, Japanese Patent Publication No. 27405/68, Japanese Laid-Open Patent Application Nos. 9677/72, 32813/72, 9727/73 and 9717/73, Japanese Patent Publication No. 34213/77, Japanese Laid-Open Patent Application Nos. 8524/75 and 38525/75, and U.S. Pat. Nos. 3,761,266 and 3,796,557.

However, none of these known techniques is capable of providing wholly satisfactory properties required for various photographic applications, such as adequate sensitivity, or sufficient maximum and minimum densities, and there still remain lots of rooms for improvement.

Namely, it is known to carry out the development under a severe condition in order to increase the maximum density of an image. However, this method has drawbacks such that the minimum density is also increased, thus leading to degradation of the sharpness of the image, and that it tends to bring about a degradation of the sensitivity. Further, it is also possible to increase the maximum density by increasing the amount of the silver halide emulsion coated. However, the minimum density is thereby likewise increased, and besides, a greater amount of a silver resource is thereby consumed. Accordingly, this method can not be regarded as a desirable technique also from the standpoint of the present social requirement for conservation of resources.

In view of the application to the field of colour photographs which have become very popular in recent years, an image having a low maximum density and a high minimum density has a fatal defect in that it is thereby impossible to reproduce a beautiful colour photograph. Accordingly, it is an important subject to develop a technique which is capable of overcoming such a defect.

SUMMARY OF THE INVENTION

Accordingly, it is a primary object of the present invention to provide a direct positive type light sensitive silver halide photographic material having an adequate light sensitivity, a high maximum density and a low minimum density at the same time.

It is a second object of the present invention to provide a novel colour diffusion transfer type light sensitive photographic material in which a direct positive type silver halide emulsion is used which is capable of forming a positive colour image without reduction of the sensitivity and having a high maximum density and a low minimum density.

A further object of the present invention is to provide a colour diffusion transfer type light sensitive photographic material having a superior image quality, in which a silver-saving, novel direct positive type silver halide emulsion is used.

The present inventors have conducted extensive studies on the above mentioned subject, and have found that the primary object of the present invention can be achieved by a direct positive type light sensitive silver halide photographic material which comprises at least one layer, on a support, containing an unfogged internal latent image type silver halide emulsion, and which is characterized in that an internal latent image type silver halide emulsion having fog centers in silver halide grains, is incorporated in said layer or in another constituent layer of the photographic material. It has been found also that the second and further objects of the present invention can be achieved by a colour diffusion transfer type light sensitive photographic material which comprises an unfogged internal latent image type silver halide emulsion layer provided on a support, in combination with a dye image forming substance incorporated in the same layer or a separate layer, and which is characterized in that an internal latent image type silver halide emulsion having fog centers in silver halide grains, is incorporated in the silver halide emulsion layer or in another constituent layer of the photographic material.

Namely, in the light sensitive photographic materials of the present invention, the unfogged internal latent image type silver halide emulsion is not used alone, but it is used in combination with an internal latent image type silver halide emulsion having fog centers in silver halide grains (hereinafter simply referred to as "silver halide emulsion having fog centers"). It has been found possible to thereby obtain an improved positive image by activating the function of the unfogged internal latent image type silver halide emulsion which used to have a low positive image forming ability when conventionally used alone.

DETAILED DESCRIPTION OF THE INVENTION

Now, the light sensitive photographic materials of the present invention will be described in detail.

As unfogged internal latent image type silver halide emulsions which may be used in the present invention, there may be mentioned, for instance, Burton's emulsion disclosed in "Photographic Emulsions" edited by Wall, conversion emulsions disclosed in U.S. Pat. No. 2,592,250, metal ion doping emulsions or internally chemically sensitized core/shell emulsions disclosed in U.S. Pat. Nos. 3,206,313 and 3,206,631, Japanese Patent Publications No. 29,012/76 and No. 29,405/68, U.S.

Pat. Nos. 3,447,927, 3,317,322, 3,531,291, 3,703,584, 3,761,266, 3,761,267 and 3,761,276, emulsions containing thioethers, as disclosed in U.S. Pat. Nos. 3,271,157, 3,574,628, 3,767,413 and 3,796,577, a primitire or surface latent image emulsion containing a desensitizing amount of a sensitizing dye or a desensitizing dye, disclosed in U.S. Pat. Nos. 3,730,723 and 3,736,140 and Japanese Laid-Open Patent Application No. 15530/73, an emulsion wherein silver chloride and silver bromide are precipitated in a laminated layer state, as disclosed in Japanese Laid-Open Patent Application Nos. 8525/75 and 38525/75, an ammonium-containing silver bromide emulsion disclosed in Japanese Laid-Open Patent Application No. 156614/77 and a neutral silver iodobromide emulsion disclosed in Japanese Patent Application No. 142027/76. However, the unfogged internal latent image type silver halide emulsion useful for the present invention is not limited to the above mentioned emulsions. Any emulsion may be used so far as it satisfies the following requirements.

Namely, when it is coated on a test piece, then exposed for a period of from 1/100 to 1 second, and developed at 20° C. for 3 minutes with the following internal developing solution, it must provide a maximum density at least five times, preferably more than 10 times, as high as the maximum density obtainable by the development at 20° C. for 4 minutes with the following surface developing solution.

Internal Developing Solution

Hydroquinone: 15 g
Monomethyl-p-aminophenol sulfate: 15 g
Sodium sulfite (anhydride): 50 g
Potassium bromide: 10 g
Sodium hydroxide: 25 g
Sodium thiosulfate (crystals): 20 g
Water: To bring the solution to one liter Surface Developing Solution p-Hydroxy phenylglycine: 10 g
Sodium carbonate (crystals): 100 g
Water: To bring the solution to one liter As the silver halide for the unfogged internal latent image type silver halide emulsion which is used in the present invention, silver bromide is mainly employed, and it is especially preferred that the silver halide composition comprises at least 50 molar % of silver bromide.

Further, with respect to the structure of the silver halide, a silver halide having a core/shell structure, namely a structure comprising a core of a chemically sensitized silver bromide and a shell of silver bromide coated thereon, is preferred. The grain size may be within a range, in an average grain diameter, of from 0.3 to 3.0 μm, preferably from 0.5 to 3.0 μm. Further, in the case of the above core/shell type silver bromide grains, of which the main component is silver bromide, the shell structure may further contain from 0 to 10 molar %, preferably from 0 to 5 molar % of silver iodide.

The above-mentioned unfogged internal latent image type silver halide emulsion which is used in the present invention may be chemically sensitized as the case requires. As such a chemical sensitizing method, there is known, for instance, sensitization with noble metals, sulfur sensitization or reduction sensitization. These sensitization methods may be used alone or in combination.

Further, the above mentioned internal latent image type silver halide emulsion may be stabilized or may be prevented from fogging, with known stabilizers or antifoggants. For this purpose, there may be used, for instance, mercury compounds, triazol compounds, azaindene compounds, benzthiazolium compounds, zinc compounds, or nitrogen-containing heterocyclic compounds having a mercapto group.

As a compound having an azaindene ring among these additives, there may preferably used 4-hydroxy-6-methyl-1,3,3a,7-tetrazaindene. As nitrogen-containing heterocyclic compounds having a mercapto group, there may preferably be used, derivatives of e.g. 5-methylbenzothiazole, 5-methylbenzotriazole, 1-phenyl-5-mercaptotetrazole, and 1-methyl-2-tetrazoline-5-thione.

Further, the above mentioned internal latent image type silver halide emulsion may be optically sensitized with use of known spectral sensitizing dyes or supersensitizers.

On the other hand, the internal latent image type silver halide emulsion having fog centers, which is used in combination with the above mentioned unfogged internal latent image type silver halide emulsion, in the present invention, is essentially the same in nature as the latter silver halide emulsion. Namely, it is an emulsion which, when coated on a test piece, then exposed for a period of from 1/100 to 1 second and developed at 20° C. for 3 minutes with the above mentioned internal developing solution, is capable of providing a maximum density at least 5 times, preferably more than 10 times, as high as the maximum density obtainable by the development at 20° C. for 4 minutes with the above mentioned surface developing solution.

Further, the internal latent image type silver halide emulsion having fog centers, must contain fog centers partially or wholly in its grains. The degree of the fogging is such that when a sample which is composed of a transparent support such as a polyethylene terephthalate film coated with the emulsion having fog centers in an amount of from 3.5 to 4.5 g/m$^2$ as evaluated as the amount of silver, is subjected to the development treatment in the above mentioned internal developing solution at 20° C. for 3 minutes, the transmission density will be at least 0.50, preferably more than 1.0. Further, the above mentioned emulsion having fog centers is such that when the above mentioned coated sample is exposed for a period of from 1/100 to 1 second, then developed in the above mentioned surface developing solution at 20° C. for 4 minutes, the maximum density will be at most 0.40, preferably at most 0.25, with its surface unfogged.

Now, a process for producing the internal latent image type silver halide emulsion having fog centers, will be described. For instance, it may be produced by fogging a silver halide emulsion of a type wherein the interior and the surface of the grains have photosensitivity, and then destroying the fog at the surface by treatment with an oxidizing agent such as an aqueous potassium ferricyanide solution. As a method for fogging to be used in this case, there is known a method of heating and aging the above mentioned silver halide emulsion in the presence of low PAg, a method of chemically fogging it with use of a foggant, or a method of exposing the entire surface. These methods may be employed singly or in combination. Further, as an alternative method, there is a method which comprises applying a radiation having a high energy, such as a X-ray, to an unfogged internal latent image type silver halide emulsion. As a still further method, there is known a method wherein firstly a silver halide emulsion having fog centers is prepared, which is then used as a core, and an unfogged silver halide is coated on the core to form a shell. In this case, the preparation of the fogged core particles can be achieved by excessive chemical sensitizing treatment e.g. by a single use or a combined use of chemical sensitizing methods which are well known in the art, such as noble metal sensitization, sulfur sensitization, and reduction sensitization. The grain size of the thus prepared internal latent image type silver halide emulsion is within a range, in an average grain diameter, of from 0.15 to 3.0 μm, preferably from 0.2 to 1.0 μm. It is desirable that the emulsion has a relatively narrow grain size distribution, and thus constitutes a so-called mono-dispersion type emulsion.

For the preparation of core/shell type grains of the internal latent image type silver halide emulsion having fog centers, a method is used which comprises firstly forming silver halide particles for cores, subjecting the particles to gold sensitizing treatment under a relatively high silver potential, and coating the core particles with an unfogged silver halide. The silver halide thus prepared is preferably used to achieve the objects of the present invention.

As the silver halide composition for the above internal latent image type silver halide emulsion to be used in the present invention, there may be used silver chloride, silver bromide, silver iodide or a silver halide composition composed of a combination of these. Especially preferred are silver chloride, silver bromide and silver iodobromide.

In the silver halide composition according to the present invention, the proportion of silver iodide is at most 10 molar %, preferably at most 3 molar %. Further, an average thickness of the shell-constituting layer in the core/shell structure of the silver halide grains according to the present invention is from 0.01 to 0.3 μm, preferably from 0.02 to 0.15 μm.

Various known photographic additives may be added or incorporated to the internal latent image type silver halide emulsion having fog centers as in the case of the above mentioned unfogged internal latent image type silver halide.

The ratio of the unfogged internal latent image type silver halide to the internal latent image type silver halide having fog centers, is within a range, in a molar ratio, of from 10:0.03 to 10:30, preferably from 10:0.5 to 10:10. If the ratio is within these ranges, no adverse effect to the sensitivity will be brought about.

The present invention is characterized by the combination of the unfogged internal latent image type silver halide emulsion and the internal latent image type silver halide emulsion having fog centers. In a practical embodiment, a part of the unfogged internal latent image type silver halide emulsion is substituted for the internal heat image type silver halide emulsion having fog centers. In this case, the amount of silver halide required, is smaller in the combined use of two emulsions according to the present invention than in the conventional single use of the internal latent image type silver halide emulsion. Thus, the present invention contributes to conservation of silver resources to a great extent.

From the comparison of the sizes of the two silver halide grains, it has been found that a superior positive image is obtainable especially when the size of the internal latent image type silver halide grains having fog centers is smaller than the average size of the unfogged internal latent image type silver halide grains.

According to the present invention, the internal latent image type silver halide having fog centers may be incorporated in the same emulsion layer as the unfogged internal latent image type silver halide, or it may be incorporated in a separate layer adjacent to the layer for the unfogged internal image type silver halide. In the latter case, an intermediate layer such as a gelatine layer may be present. However, a superior result is obtainable especially when the two emulsion layers are directly laminated.

As a binder for forming a lamination of the constituent layers of the direct positive type light sensitive silver halide photographic material of the present invention, there may be used a wide variety of generally known hydrophilic binders such as gelatine, and gelatine derivatives such as acylated gelatine, guanidine modified gelatine, and carbamine modified gelatine, and other hydrophilic polymer compounds. With use of these hydrophilic binders, the constituting layers for a light sensitive photographic material, such as a light sensitive emulsion layer, a protecting layer, an intermediate layer, a filter layer and a backing layer, are provided on a support, as the case requires, to form the above mentioned light sensitive photographic materials. Depending upon the particular purpose, appropriate additives such as a plasticizer, a wetting agent, and a hardner may be incorporated in each of the constituting layers. As the hardener, there may be mentioned various hardners which are generally well known, such as aldehyde compounds, azine compunds, epoxy compounds, ethyleneimine compounds, vinyl sulfonic compounds, or acryloyl compounds.

The direct positive type light sensitive silver halide photographic material of the present invention thus prepared, will be subjected, after image exposure, to fogging treatment. This fogging treatment may be carried out either prior to surface development, or at the same time as the surface development. Usually, it is preferred that the fogging treatment and the surface development are carried out simultaneously. As mentioned above, there are many methods for fogging, such as a method for exposing the entire surface, a method of using a foggant, a method of using a strong developing solution or a method by means of a high temperature treatment or heating treatment. With respect to the method of using a foggant, there are disclosed an aerial fog facilitating agent in U.K. Pat. No. 645,877 and U.S. Pat. No. 2,497,917, hydrazine and hydrazide compounds in U.S. Pat. Nos. 2,563,785, 2,588,982, 2,685,514 and 3,227,552, U.K. Pat. Nos. 1,269,640 and 1,403,018, Japanese Patent Publication No. 17184/66, and Japanese Laid-Open Patent Application No. 3326/78, quaternary ammonium salt compounds in U.S. Pat. Nos. 3,330,655 and 3,615,615, Japanese Laid-Open Patent Application Nos. 9677/72, 3426/77, and 69613/77, and Japanese Patent Publication No. 47326/77, carbazinic acid compounds in U.S. Pat. No. 3,565,620, tin compounds in German Pat Nos. 2,141,554 and 2,314,517, benzimidazole compounds in U.S. Pat. No. 3,850,638, and amine-borane compounds in Japanese Patent Application No. 142026/76. Hydrazine compounds are preferably used. These foggants may be added to the developing solution or to the silver halide emulsion layer at a proper time.

The above mentioned surface developing solution which is used in the present invention is one which has no or weak ability to dissolve the silver halide grains and contains various silver halide developing agents or reducing agents and substantially no relatively strong silver halide dissolving agents (such as water soluble thiocyanates, thioethers, thiosulfates or ammonia). For instance, there may be mentioned Kodak DK-50 and D-19 and Sakura Colour II Developing Solution CNK-4. However, most of commercially available developing solutions belong to the above mentioned category.

In normal silver halide developing agents used as the above mentioned developing solution of the present invention, hydroquinones, catechols, aminophenols, 3-pyrazolidones, ascorbic acid and its derivatives, reductones or phenylenediamines, or mixtures thereof, are incorporated. It is also possible that these developing agents are preliminarily incorporated in the emulsion layer, and activated during the immersion in a high pH aqueous solution to act on the silver halide.

The developing composition which is used in the present invention may further contain a certain antifoggant and development retarder, or such a composition may optionally be incorporated in the layer of the light sensitive silver halide photographic material. Useful antifoggants include conventionally known heterocyclic thiones, and aromatic and aliphatic mercapto compounds.

After the development with the surface developing solution carried out subsequently to or simultaneously with the fogging treatment, the direct positive type light sensitive silver halide photographic material of the present invention is subjected to usual treatments of fixing, washing with water and drying to complete the processing.

In another embodiment of the present invention, a dye image forming substance is incorporated in a constituting layer of the above mentioned photographic material to form a colour diffusion transfer type light sensitive photographic material.

The dye image forming substances useful for the present invention are those which are capable of providing an image pattern distribution of a diffusible dye or its precursor when the development proceeds upon subjecting the silver halide emulsion to development treatment after exposure. The dye image forming substances include those which are diffusible under an alkaline condition and those which are non-diffusible under an alkaline condition.

A typical example of the dye image forming substance having a diffusible property under an alkaline condition is a so-called dye developer. The dye developer is a compound which has, within its molecule, a dye portion or its precursor portion, and a developer portion or its precursor portion, and which is disclosed, for instance, in U.S. Pat. No. 2,983,606. This dye developer is converted to be non-diffusible when the silver halide is developed. The dye image forming substances having non-diffusible property in an alkaline condition may generally be classified into those which form a diffusible dye or its precursor as the development of silver halide proceeds, and those which form a diffusible dye or its precursor in inverse proportion to the progress of the development. As typical examples of the former, there may be mentioned diffusible dye releasing coupler (DDR coupler) as disclosed, for instance, in U.S. Pat. Nos. 3,227,550 and 3,443,940, and so-called Redox dye releasing compounds (RDR compounds) as disclosed, for instance, in Japanese Laid-Open Patent Application Nos. 33826/73, 104343/76, 113624/76 and 54021/79. Further, as typical examples of the latter, there may be mentioned dye image forming substances which are capable of releasing a duffusible dye or its precursor under an alkaline condition but the releasing speed being lowered by oxidation, as disclosed, for instance, in Japanese Laid-Open Patent Application Nos. 111628/74, and 63618/76, and substances which do not substantially release a diffusible dye or its precursor under an alkaline condition but which is capable of releasing a diffusible dye or its precursor when reduced, as disclosed, for instance, in Japanese Laid-Open Patent Application Nos. 110827/78 and 110828/78.

The above mentioned diffusible dye releasing couplers (DDR couplers) are those which release a diffusible dye or its precursor by a coupling reaction with an aromatic quaternary colour developing oxidized agent. Preferred compounds are represented by the following formulas (I) and (II).

DYE-LINK-COUP-BALL (I)

BALL-LINK-(COUP)′ (II)

where DYE represents a diffusible dye group or its precursor group, LINK represents a bivalent bond selected from the group consisting of —O—, —S—, —N=N— and —$SO_2NH$— (provided the nitrogen atom is bonded to COUP or (COUP)′), COUP represents a coupler group selected from the group consisting of a 5-pyrazolone coupler, a phenol coupler, a naphthol coupler, an open-chained keto-methylene coupler, an indanone coupler and a cyclopentanone coupler, and (COUP)′ represents a coupler group selected from the group consisting of a 5-pyrazolone coupler, a phenol coupler, a naphtol coupler and an open-chained keto-methylene coupler (provided each of COUP and (COUP)′ is bonded to LINK at the coupling position) and BALL represents a photographically inactive ballast group having a molecular size and/or conformation capable of maintaining the non-diffusible dye image forming substance of the general formula I or II to be non-diffusible under an alkaline condition.

In the case where the diffusible dye releasing coupler represented by the general formula I is used, as a result of the coupling reaction, the dye or its precursor bonded to the active point will be released and diffused into the image receiving layer, thereby to form a transferred dye image.

On the other hand, in the case where the diffusible dye releasing coupler represented by the general formula II is used, a colour developing dye produced by the coupling reaction will be diffused into the image receiving layer, thereby to form a transferred dye image.

Redox dye releasing compounds (RDR compounds) are those which are capable of releasing a diffusible dye or its precursor under an alkaline condition when oxidized by a redox reaction. The RDR compounds are usually oxidized by the redox reaction with an oxidation product of a silver halide developing agent. The RDR compounds per se are non-diffusible in an alkaline condition. Preferred RDR compounds are represented by the following general formula III.

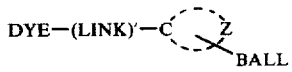

III where (LINK)′ represents —O—, —S—, —$SO_2$— or —$SO_2NH$— (provided the nitrogen atom is bonded to

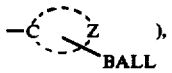

Z represents a group of non-metallic atoms required to form a 5- or 6-member ring which is capable of being separated together with the carbon atom linked to the (LINK)′ from the (LINK)′ under an alakline condition by the oxidation-reduction reaction with the above mentioned oxidation product of a silver halide developing agent, and DYE and BALL are the same as defined in the general formula I.

As particularly preferred

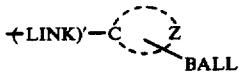

of the RDR compounds represented by the general formula III, there may be mentioned those represented by the following general formulas IIIa, IIIb, IIIc, IIId, IIIe and IIIf.

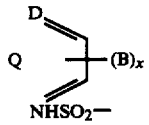

IIIa where Q is a group of non-metallic atoms required to form a 6-member aromatic ring (which includes a 6-member aromatic ring to which a saturated or unsaturated carbon ring or hetero ring is attached).

As preferred 6-member aromatic rings, there may be mentioned, for example, a benzene ring, a naphthalene ring, a quinoline ring, and a tetralin ring.

B represents a halogen atom, a sulfo group, a carboxyl group, an alkyl group, an alkoxy group, an aryloxy group, a nitro group, an amino group, an cyano group, an alkylamino group, an arylamino group, an alkylthio group or a heterocyclic group such as a pyridyl group which is directly or via

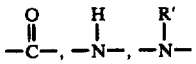

(where R′ is an alkyl group), an alkylene group (which may be straight or branched), —O—, —S—, —$SO_2$—, a phenylene group (which may be substituted by e.g. an alkyl group) or an optional combination thereof, attached to said 6-member aromatic ring formed by the above Q.

Preferred groups or atoms represented by B are, for example, a hydrogen atom, a halogen atom, a lower alkyl, alkoxy or acylamino group, and a so-called ballast group which is capable of maintaining the RDR compounds to be non-diffusible in an alkaline condition, particularly under a condition of a hydroxyl ion concentration being from $10^{-5}$ to 2 mol/l, such as an alkyl group, an alkoxy group, an allyloxy group, an amino group, an acylamino group, a sulfoamino group, a ureido group, an alkoxycarbonyl group, a carbamoyl group, and a sulfamoyl group (these groups may further be substituted by an alkyl group, an aryl group, an alkoxyalkyl group, an alkylaryl group, an alkylallyloxyalkyl group, an acylamidoalkyl group, an alkoxyaryl group, or an aryloxyaryl group), which preferably contain from 8 to 32 carbon atoms.

D represents a group represented by —$OR^{(1)}$ or —$NHR^{(2)}$, where $R^{(1)}$ is preferably a hydrogen atom, but it may be a group which can be split from the oxygen atom under a condition of a hydroxyl ion concentration being from $10^{-5}$ to 2 mol/l. The group which can be split, may preferably be, for instance,

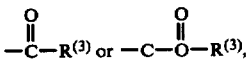

where $R^{(3)}$ is an alkyl group, preferably an alkyl group having from 1 to 5 carbon atoms, such as —$CH_3$, —$C_2H_5$, —$C_3H_7$(n), —$C_4H_9$(iso), and —$C_5H_{11}$(n). Further, also preferred is said alkyl group substituted by a halogen atom, such as —$CH_2Cl$ or —$CF_3$. $R^{(3)}$ may be a phenyl group such as —$C_6H_5$, —$C_6H_4Cl$, or —$C_6H_4CN$.

$R^{(2)}$ represents a hydrogen atom or an alkyl group, preferably an alkyl group having from 1 to 22 carbon atoms such as —$CH_3$, —$C_3H_7$(n), or —$C_{12}H_{25}$(n). Further, it may be a group which can be split from the N atom under a condition of a hydroxyl ion concentration being from $10^{-5}$ to 2 mol/l. The group which can be split, may preferably be

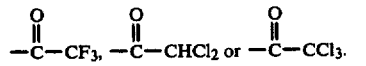

x is an integer of 1, 2 or 3. In a case where x is an integer of 2 or 3, B may be the same or different groups. Further, the group represented by the general formula IIIa preferably has a total carbon number of at least 8 in $(B)_x$ and the alkyl group of $R^{(2)}$ in —$NHR^{(2)}$ in D of the general formula IIIa in order to maintain the RDR compounds represented by the general formula III to be non-diffusible under an alkaline condition, particularly under a condition of a hydroxyl ion concentration being from $10^{-5}$ to 2 mol/l. It is especially preferred that at least one of $(B)_x$ is a ballast group having at least 8 carbon atoms.

As preferred specific examples, the following may be mentioned:

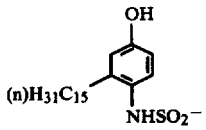

IIIa-1

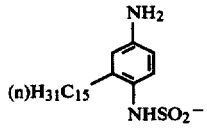

IIIa-2

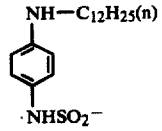

IIIa-3

-continued
IIIa-4
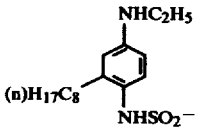
IIIa-5
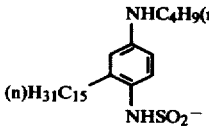
IIIa-6
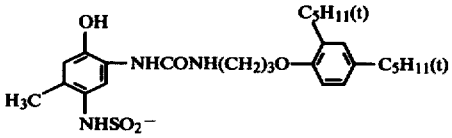
IIIa-7
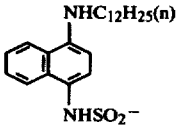
IIIa-8
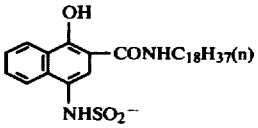
IIIa-9
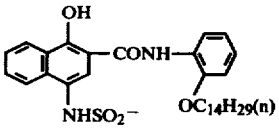
IIIa-10
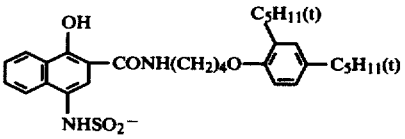
IIIa-11
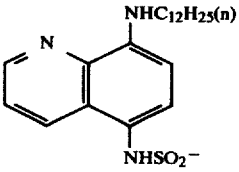
IIIa-12
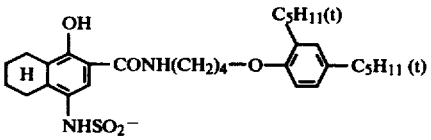
IIIa-13
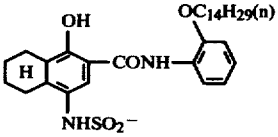
IIIa-14
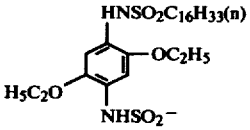
-continued
IIIa-15
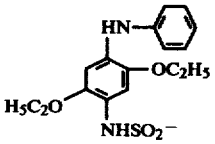
IIIa-16
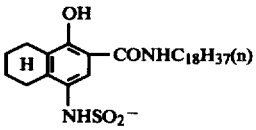
IIIa-17
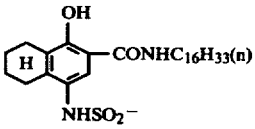
IIIa-18
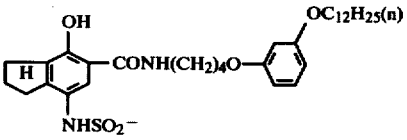
IIIa-19
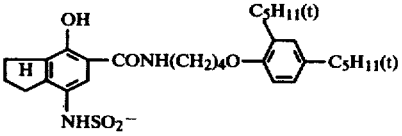
IIIb
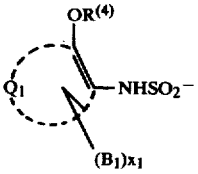
where $Q_1$, $B_1$, $R^{(4)}$ and $x_1$ are the same as Q, B, $R^{(1)}$ and x, respectively, of the general formula IIIa.
Representative examples are as follows:
IIIb-1
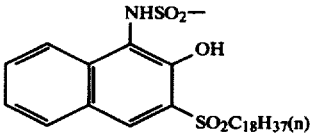
IIIb-2
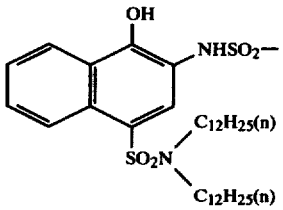
IIIb-3
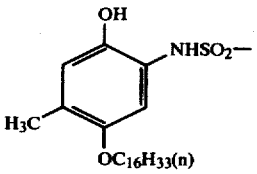

-continued
IIIb-4
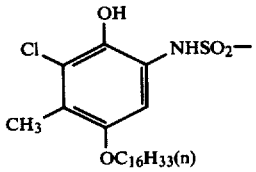
IIIb-5
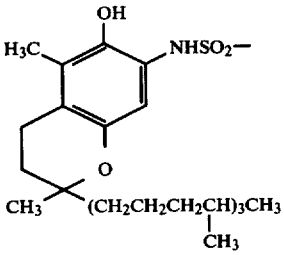
IIIb-6
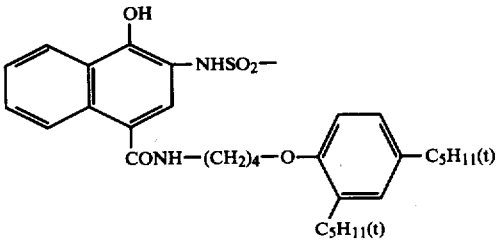
IIIb-7
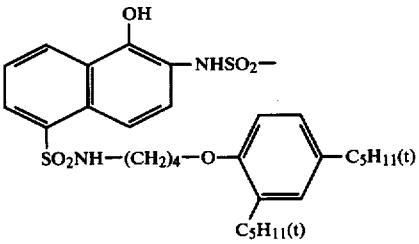
IIIb-8
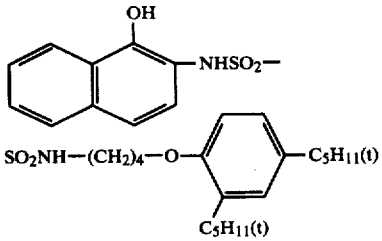
IIIb-9
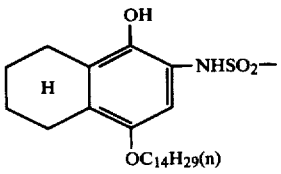
IIIb-10
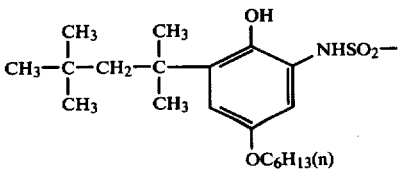
-continued
IIIb-11
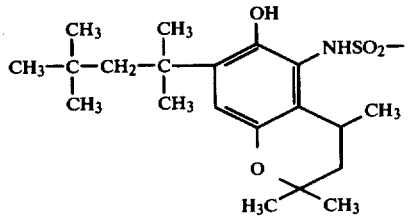
IIIb-12
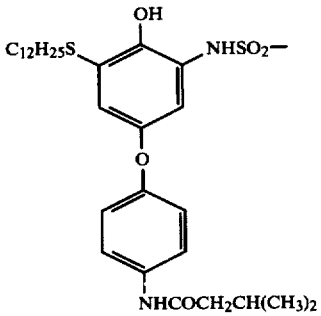
IIIb-13
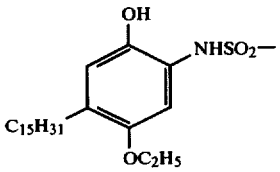
IIIb-14
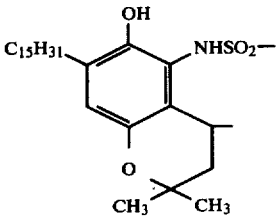
IIIb-15
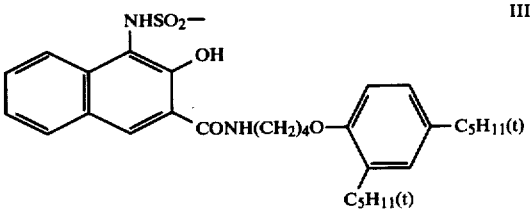
IIIb-16
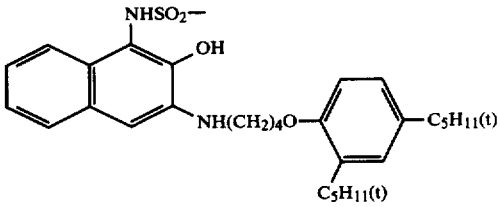
IIIb-17
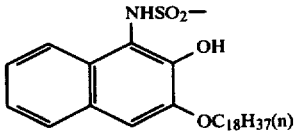

-continued

IIIb-18

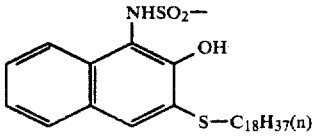

IIIb-19

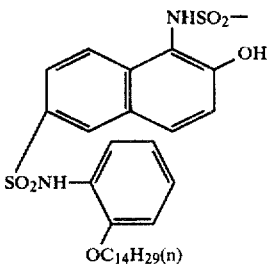

IIIc

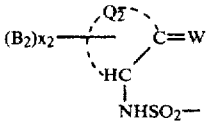

where $B_2$ and $x_2$ are the same as B and x, respectively, of the above mentioned general formula IIIa, and W is an oxygen atom or $=NR^{(5)}$ (where $R^{(5)}$ is a hydroxyl group or an amino group which may have a substituent). Particularly, in the case where W is $=NR^{(5)}$, a typical example of $R^{(5)}$ is $R^{(5)}$ in a $>C=N-R^{(5)}$ group formed by subjecting a carbonyl reagent represented by the formula $H_2N-R^{(5)}$ to a dehydration reaction with a ketone group. In this case, as the compound of the formula $H_2N-R^{(5)}$, there may be mentioned, for instance, hydroxylamines, hydrazines, semicarbazides, or thiosemicarbazides. As specific examples of the hydrazines, there may be mentioned hydrazine, phenyl hydrazine, a substituted-phenyl hydrazine having, on its phenyl group, an aryl group, an alkoxy group, a carboalkoxy group or a halogen atom, and isonicotic acid hydrazine. As the semicarbazides, there may be mentioned phenylsemicarbazide a substituted phenylsemicarbazide having a substituent such as an alkyl group, an alkoxy group, a carboalkoxy group or a halogen group. Likewise, with respect to the thiocarbazides, there may be mentioned various derivatives as in the case of the semicarbazides.

Further, $Q_2$ in the formula represents a group of non-metallic atoms required to form together with the carbon atom a 5- or 6-member saturated or unsaturated non-aromatic hydrocarbon ring. As typical specific examples of the hydrocarbon ring, there may be mentioned, for instance, cyclopentane, cyclohexane, cyclohexene, and cyclopentene.

Further, this 5- or 6-member non-aromatic hydrocarbon ring includes a condensed ring formed by a condensation with another ring at a proper position of the non-aromatic hydrocarbon ring. In this case, said another ring may be aromatic or non-aromatic, or it may be a hydrocarbon ring or a hetero ring. However, for the purpose of the present invention, it is preferred that the condensed ring is formed by a condensation of a benzene ring such as benzcyclopentene, or benzcyclohexene with the above mentioned 5- or 6-member non-aromatic hydrocarbon ring.

Specific examples of the compounds of the general formula IIIa are as follows;

IIIc-1

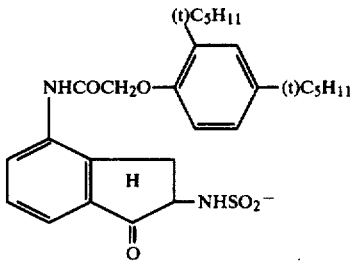

IIIc-2

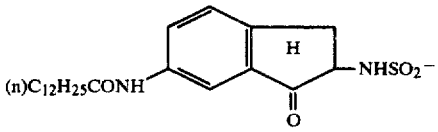

IIIc-3

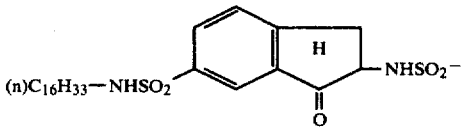

IIIc-4

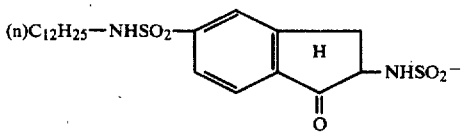

IIIc-5

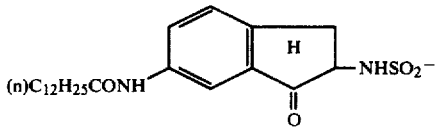

IIIc-6

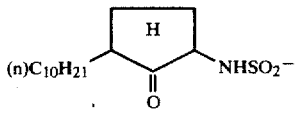

IIIc-7

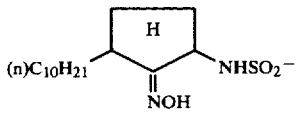

IIIc-8

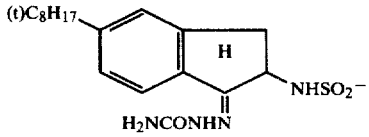

IIIc-9

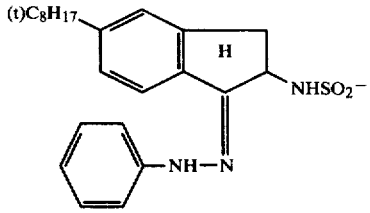

-continued

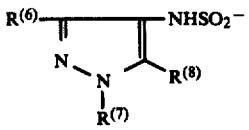

IIId $R^{(6)}$ is preferably an alkyl group, an acylamino group or an arylamino group, and these groups may further be substituted by an alkoxy group, an alkylthio group, an aryloxy group, a carboxyl group, an acylamino group, a hydroxyl group, a sulfamoyl group, or a halogen atom. $R^{(7)}$ represents an alkyl group, an aryl group such as a phenyl group, an acyl group such as an alkyl carbonyl group or an arylsulfonyl group, or a heterocyclic group, and these groups may further be substituted by a halogen atom or a sulfo group. $R^{(8)}$ represents $—OR^{(9)}$ (where $R^{(9)}$ is the same as $R^{(1)}$ in the general formula IIIa) or $—NR^{(10)}R^{(11)}$ (where each of $R^{(10)}$ and $R^{(11)}$ represents a hydrogen atom, an alkyl group, an aryl group, a heterocyclic group or an acyl group). Further, $R^{(7)}$ and $R^{(8)}$ may together form a 5- or 6-member heterocyclic ring including at least one oxygen or nitrogen atom. Furthermore, the group represented by the general formula IIId, is preferably a ballast group defined with respect to IIIa and in which at least one of $R^{(9)}$ and $R^{(7)}$ has at least 8 carbon atoms so that it is capable of maintaining RDR compounds represented by the general formula III to be non-diffusible under an alkaline condition, particularly under a condition of a hydroxyl ion concentration being from $10^{-5}$ to 2 mol/l.

Preferred specific examples of the group represented by the general formula IIId are as follows:

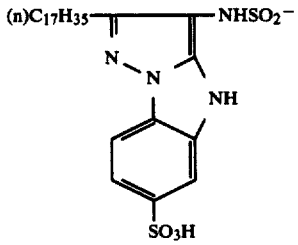

IIId-1

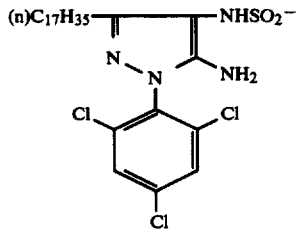

IIId-2

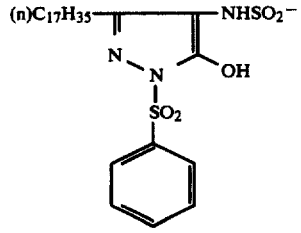

IIId-3

-continued

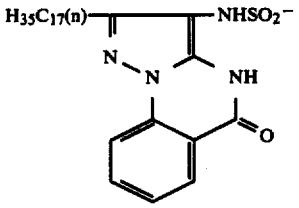

IIId-4

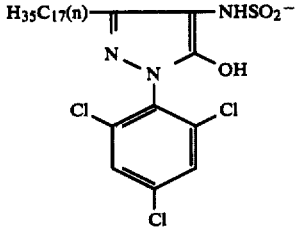

IIId-5

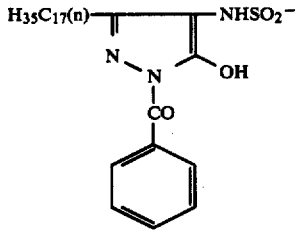

IIId-6

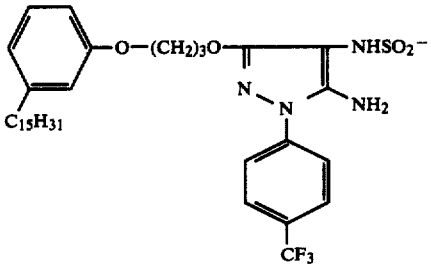

IIId-7

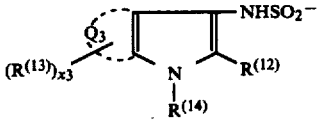

IIIe

In the formula IIIe, Q represents a group of non-metallic atoms required to form a 5- or 6-member ring, preferably a 6-member aromatic ring. $R^{(12)}$ represents a hydrogen atom, a halogen atom, a hydroxyl group, a cyano group, an amino group, an alkyl group, an aryl group, a carbamoyl group, a carbamido group, an alkoxycarbamoyl group or a heterocyclic group. $R^{(13)}$ represents a hydrogen atom, a halogen atom, a hydroxyl group, a cyano group, a sulfo group, a carboxyl group, an alkyl group, an aryl group, an alkoxy group, an acyl group, an amino group, a carbamide group or an acyloxy group. $R^{(14)}$ represents a hydrogen atom, an alkyl group, an aryl group or a heterocyclic group.

$x_3$ is an integer of from 1 to 4. In a case where $x_3$ is from 2 to 4, each $R^{(3)}$ may be the same or different. Further, $R^{(14)}$ may form together with $R^{(12)}$ and/or $R^{(13)}$ a 5- or 6-member hetero ring. Further, each of $R^{(12)}$, $R^{(13)}$ and $R^{(14)}$ may further be substituted by an alkyl group, an aryl group, an alkoxyalkyl group, an alkylaryl group, an alkylaryloxyalkyl group, an acylamidoalkyl group, an alkoxyaryl group or an aryloxyalkyl group.

Further, the group represented by the general formula IIIe should preferably have a total carbon number of at least 8 in $R^{(12)}$, $R^{(13)}$ and $R^{(14)}$ so as to maintain the RDR compounds represented by the general formula III to be non-diffusible under an alkaline condition, particularly under a condition of a hydroxyl ion concentration being from $10^{-5}$ to 2 mol/l. It is especially preferred that at least one of $R^{(12)}$, $R^{(13)}$ and $R^{(14)}$ is a ballast group (which is the same as defined with respect to the general formula IIIa) having at least 8 carbon atoms.

As specific examples, the following may be mentioned:

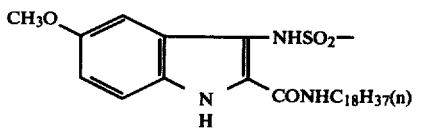
IIIe-1

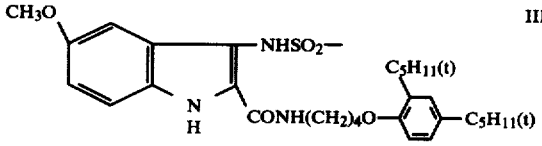
IIIe-2

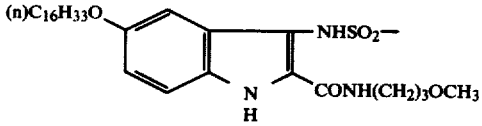
IIIe-3

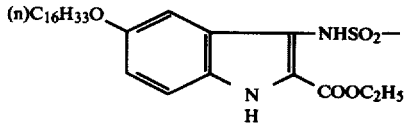
IIIe-4

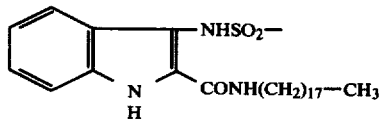
IIIe-5

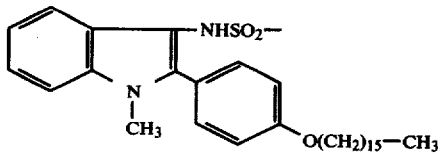
IIIe-6

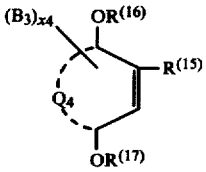
IIIf

In the general formula IIIf, $B_3$ and $Q_4$ are the same as B and Q, respectively, defined with respect to the general formula IIIa, and $R^{(16)}$ and $R^{(17)}$ are the same as $R^{(1)}$ defined with respect to the general formula IIIa.

$x_4$ is an integer of from 1 to 3. In a case where $x_4$ is 2 or 3, $B_3$ may be the same or different.

$R^{(15)}$ represents —O—, —S— or —$SO_2$—.

It is preferred that at least one of $B_3$ is the above mentioned ballast group.

As typical specific examples, the following may be mentioned.

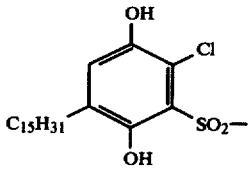
IIIf-1

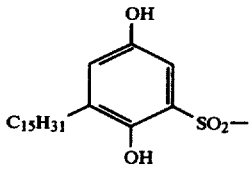
IIIf-2

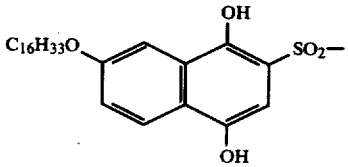
IIIf-3

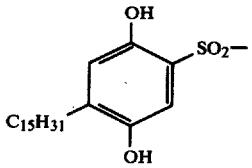
IIIf-4

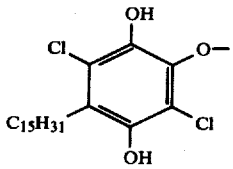
IIIf-5

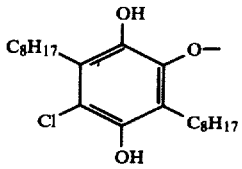
IIIf-6

Referring to the general formulas I and III, as the DYE, there may be mentioned known types of dye groups such as an azo dye, an azomethine dye, an indoaniline dye, an indophenol dye, an anthraquinone dye, an azopyrazolone dye, an alizarin dye, a merocyanine dye, a cyanine dye, an indigoid dye or a phthalocyanine dye. Further, as the precursor of the diffusible dye, there may be mentioned a leuco dye (e.g. a leuco dye in the dye developing agent disclosed in Japanese Laid-Open Patent Application No. 66440/73) or a shift dye (which is a dye, the absorption spectrum of which shifts bathochromically or hypsochromically, from before to after the alkali treatment, e.g. an acyloxynaphthylazo dye as disclosed in Japanese Patent Application No. 77148/76 or a dye, the absorption spectrum of which shifts bathochromically or hypsochromically from before to after the transfer to the image receiving layer).

In the colour diffusion transfer type light sensitive photographic material of the present invention, the above mentioned unfogged internal latent image type silver halide emulsion, the internal latent image type silver halide emulsion having fog centers and the dye image forming substance may be incorporated in any combination into any layers constituting the light sensitive photographic material. However, it is preferred that the unfogged internal latent image type silver halide emulsion and the internal latent image type silver halide emulsion having fog centers are incorporated in the same layer and the dye image forming substance is incorporated in a layer adjacent thereto, or that the internal latent image type silver halide emulsion having fog centers and the dye image forming substance are incorporated in the same layer and the unfogged internal latent image type silver halide emulsion is incorporated in a layer adjacent thereto. The latter is particularly preferred. Further, in the above construction, it is possible to provide an intermediate layer such as a gelatine layer between the adjacent layers. However, it is preferred that the adjacent layers are directly in contact with each other.

Further, the colour diffusion transfer type light sensitive photographic material according to the present, may be provided, on a known type support, with in addition to the above mentioned light sensitive emulsion layers, various layers as the case requires, such as a protecting layer, a filter layer, a backing layer, a light reflecting layer, a light impermeable layer, an acidic neutralizing layer, or an image receiving layer. As a hydrophilic binder for the various constituting layers, there may be used known gelatine derivatives including gelatine, or known hydrophilic polymer compounds. Further, in each of the above constituting layers, there may be optionally incorporated a hardner such as an aldehyde compound, a polyepoxy compound, an ethyleneimine compound, or a vinylsulfone compound, a plastisizer or a wetting agent to improve the physical properties of the coating film.

The colour diffusion transfer type light sensitive photographic material of the present invention thus prepared, is subjected to fogging treatment after image exposure. This fogging treatment may be carried out prior to or simultaneously with surface development. It is normally preferred to carry out the fogging treatment and surface development at the same time. The fogging treatment may be carried out by a method of exposing the entire surface, a method of using a foggant, a method of using a strong developing solution, or a method by means of high temperature treatment or heat treatment. The foggant which is used for the colour diffusion transfer type light sensitive photographic material, may be selected from hydrazine, hydrazide compounds, tertiary ammonium salt compounds, carbazinic acid compounds, tin compounds, benzimidazol compounds, amine-boran compounds disclosed in the forgoing various patents. Among then, hydrazine compounds are preferably used. These foggants may be added to the developing solution, or it may be added to the silver halide emulsion at a proper time.

The surface developing solution to be used, may be the one as described hereinabove. As mentioned above, a normal silver halide developing agent in the developing solution, contains a hydroquinone, a catecol, an aminophenol, a 3-pyrazolidone, ascorbic acid or a mixture thereof. It is possible that the developing agent is preliminarily incorporated in an emulsion layer so that it acts on silver halide when dipped in a high pH aqueous solution.

Further, the developing composition to be used, may further contain a certain antifoggant or a development inhibitor, or such a composition may be incorporated suitably in each constituting layer of the colour diffusion transfer type light sensitive photographic material. As such an antifoggant, there may be used a conventionally known heterocyclic thion, or aromatic or aliphatic mercapto compound.

The colour diffusion transfer type light sensitive photographic material of the present invention produces, when developed after exposure with a known viscous developing agent commonly used in a colour diffusion transfer process, a colour image by diffusion transferring the dye or its precursor distributed in a photo-image pattern to the image receiving layer, or by removing the substances which eventually become unnecessary, by diffusion transfer, and utilizing the dye thereby remained and distributed in the photo image pattern.

As described in detail in the foregoing, the colour diffusion transfer type light sensitive photographic material of the present invention, utilizes a direct positive type light sensitive silver halide photographic material having an improved image property, in which an internal latent image type silver halide emulsion having fog centers is incorporated in a constituting layer of the photographic material which has, on its support, an unfogged internal latent image type silver halide layer which is combined in the same layer or in a separate layer with a dye image forming substance which is capable of forming a diffusable dye when developed, whereby it is possible to obtain a positive colour image having a high maximum density and a low minimum density.

Thus, the direct positive type light sensitive silver halide photographic material having a dye image forming substance incorporated therein can be utilized for colour photography.

Further, the direct positive type light sensitive silver halide photographic material of the present invention is useful not only for black and white photography for general use, but also for various other applications such as X-ray photography, printing, infrared photography, microphotography, pseud colour photography, and a silver dye bleach process.

Now, the photographic materials of the present invention will be described in further details with reference to Examples. However, it should be understood that the present invention is not limited to these specific Examples.

EXAMPLE 1

Direct Positive Type Light Sensitive Light Sensitive Silver Halide Photographic Material (a) Preparation of an internal latent image type silver halide emulsion (A) having fog centers in the silver halide grains One liter of an aqueous solution containing 2.2 g of potassium bromide and 20 g of gelatine dissolved therein, was stirred at 60° C. Added simultaneously and for 20 seconds to this solution, were 150 ml of an aqueous solution containing potassium bromide and potassium iodide dissolved therein to bring the halogen ion concentration in the solution to 3.5 mol/l, and 150 ml of an ammoniac silver nitrate solution having the same concentration as above.

After stirring the mixture at 60° C. for one minute, 20 ml of an aqueous solution containing 10 g of silver nitrate dissolved therein, was added. Ten minutes later, an aqueous solution containing 1.56 mg of potassium chloroaurate and 7.19 mg of ammonium thiocyanate, per mole of silver halide, was added. The mixture was ripened at 60° C. for 50 minutes.

Thus, silver halide grains having fog centers were formed. Then, 600 ml of an aqueous solution prepared by dissolving potassium bromide and potassium iodide to bring the halogen ion concentration to 0.5 mol/l, and 500 ml of an aqueous silver nitrate solution having the same concentration were simultaneously added, whereby an internally fogged emulsion (A) comprising tetradecahedron silver halide grains having an average grain size of 0.4 μm was obtained.

(b) Preparation of an internal latent image type silver halide emulsion (B) having fog centers in the silver halide grains The preparation was made in substantially the same manner as the above mentioned internally fogged emulsion (A). However, the amount of the silver nitride added to the final adjusting stage of the above mentioned internally fogged emulsion (A) was increased to increase the halogen ion concentration, whereby an internally fogged emulsion (B) comprising tetradecahedron silver halide grains having an average grain size of 0.50 μm was obtained.

Each of the emulsions (A) and (B) was applied onto a polyethyleneterephthalate film support, each in an amount of about 3.5 g/m$^2$ as evaluated as the amount of silver to obtain a test piece. The test piece thus obtained was subjected to image exposure for 1/25 second and then developed for 4 minutes at 20° C. with use of the above mentioned surface developing solution. No image appeared and no formation of fog was observed. In order to investigate the internal fog of silver halide grains, the above test piece was subjected to development treatment for 3 minutes at 20° C. in the above mentioned internal developing solution.

As a result, in each case of the internally fogged emulsions (A) and (B), a transmission density of at least 2.0 was observed.

Next, an unfogged internal latent image type silver halide emulsion was prepared in accordance with Example 9 of Japanese Patent Publication No. 34213/77.

The surface of the above mentioned silver halide grains was chemically sensitized in accordance with the method disclosed in Example 9 of the above Patent Publication. To this unfogged internal latent image type silver halide emulsion, each of the internally fogged emulsions (A) and (B) was mixed in a proportion as indicated in the following Table 1. The mixture was applied onto a polyethylene terephthalate support to obtain a test piece. The amount of silver halide applied, was about 3.5 g/m$^2$ as evaluated as the amount of silver, with respect to each test piece.

Each test piece was exposed for 1/25 second through an optical wedge, and then developed for 6 minutes at 20° C. in the following fogging developing solution, whereupon a positive image was obtained.

Fogging Developing Solution

Anhydrous sodium sulfite: 2.6 g
Sodium phosphate, tribasic, 12 hydrate: 30.0 g
Sodium hydroxide: 2.5 g
5-Methylbenzotriazole: 3.0 g
4-Hydroxymethyl-4-methyl-1-phenyl-3-pyrazolidone: 1.5 g
Water: To bring to one liter The results thereby obtained are shown in Table 1. It is seen that the combination of the unfogged internal latent image type silver halide emulsion and the internal latent image type silver halide emulsion having fog centers, brings about an effect that Dmax is greater and Dmin is smaller than the comparative test sample. In Table 1, Nos. 4 to 6 represent the photographic materials of the present invention.

TABLE 1

| No. | Relative amounts of the unfogged internal latent image type silver halide emulsions | Relative amounts of the internally fogged emulsions (A) and (B) | Dmax | Dmin | Relative sensitivity |
|---|---|---|---|---|---|
| 1 | 1.0 | — | 1.04 | 0.13 | 100 |
| 2 | 0.8 | — | 0.91 | 0.12 | 98 |
| 3 | 0.6 | — | 0.89 | 0.10 | 97 |
| 4 | 0.8 | (A) 0.2 | 1.25 | 0.12 | 99 |
| 5 | 0.6 | (A) 0.4 | 1.21 | 0.11 | 97 |
| 6 | 0.8 | (B) 0.2 | 1.27 | 0.12 | 98 |
| 7 | — | (A) 1.0 | no image formation | — | — |
| 8 | — | (B) 1.0 | no image formation | — | — |

EXAMPLE 2

Direct Positive Type Light Sensitive Silver Halide Photographic Material Combined with Dye Image Forming Substance A unfogged internal latent image type silver halide emulsion comprising silver bromide was prepared in accordance with the disclosure of Example 9 of Japanese Patent Publication No. 34213/77. The surface of the silver halide grains was chemically sensitized by the method disclosed in the above Patent Publication. This silver halide emulsion and the internally fogged emulsion (A) prepared by Example 1 were mixed in the proportions indicated in the following Table 2. On the other hand, 39 g of 1-(2,4,6-trichlorophenyl)-3-(2-chloro-5-octadecylsuccinimidoanilino)-5-pyrazolone as a magenta coupler was emulsified and dispersed in 500 ml of a 5% gelatine aqueous solution containing sodium dodecylbenzene sulfonate to prepare an emulsified dispersion.

The emulsified dispersion was added to an emulsion mixture prepared by mixing the unfogged internal latent image type silver halide emulsion and the internally fogged emulsion in a predetermined proportion as indicated in Table 2, in a proportion of 1.42 l per mol of the silver halide, and mixed, and then an acetone solution containing 5% of tetrakis(vinylsulfonylmethyl) methane as a film hardener was added in a proportion of 70 ml per mol of the silver halide. The mixture thus prepared was applied onto a cellulose triacetate film in an amount to bring the applied silver amount to 20 mg/100 $cm^2$, and then dried.

As a comparative sample, there was used an emulsion prepared in the same manner as the above, except that the internally fogged emulsion was not added.

Each sample thus prepared was exposed through an optical wedge, and then developed for 5 minutes at 20° C. with use of the following developing solution.

Developing Solution

4-Amino-3-methyl-N-ethyl-N-(β-methane sulfonamide ethyl) aniline sulfate: 5 g
Sodium sulfite (Anhydrous): 2 g
Sodium phosphate, tribasic, 12 hydrate: 40 g
Benzimidazole: 50 ml
1-Acetyl-2-phenylhydrazine: 1 g
Water: To bring to one liter
(The pH was adjusted to 12.0 with sodium hydroxide)

After the development, each sample was subjected to normal procedures of bleaching, fixing, washing with water, and drying. The colour positive image thereby obtained is shown in Table 2. As apparent from Table 2, in the case of the emulsion combined with the internally fogged emulsion, the maximum density (Dmax) of the positive dye image was increased and the minimum density (Dmin) was decreased as compared with the comparative sample. Further, it is clearly shown from the sample No. 4 that this effect is obtainable by a smaller amount of the combined emulsion according to the present invention than the amount of the single use of the unfogged internal latent image type silver halide emulsion. This indicates superiority of the direct positive type light sensitive silver halide photographic material of the present invention.

TABLE 2

| No. | Relative amounts of the mixed emulsions: Unfogged emulsions | Relative amounts of the mixed emulsions: Internally fogged emulsions | Positive images: Dmax | Positive images: Dmin |
|---|---|---|---|---|
| 1 (Comparative Sample) | 1 | 0 | 1.95 | 0.15 |
| 2 (Present Invention) | 0.9 | 0.1 | 2.18 | 0.13 |
| 3 (Present Invention) | 0.8 | 0.2 | 2.40 | 0.11 |
| 4 (Present Invention) | 0.7 | 0.2 | 2.31 | 0.10 |

EXAMPLE 3

Colour Diffusion Transfer Type Light Sensitive Photographic Material (a) Preparation of an internal latent image type silver halide emulsion having fog centers An internal latent image type silver halide emulsion having fog centers was prepared in the same manner as the procedure (a) of Example 1.

(b) Preparation of an unfogged internal latent image type silver halide emulsion An internal latent image type silver bromide emulsion was prepared in accordance with the disclosure of Example 9 of Japanese Patent Publication No. 34213/77. This silver bromide emulsion was divided into three equal portions, which were subjected to spectral sensitization to obtain a blue sensitive emulsion, a green sensitive emulsion and a red sensitive emulsion, respectively.

With use of the sensitized internal latent image type silver bromide emulsions, thin layers having the following compositions were successively applied on a transparent cellulose acetate film support to form a multilayer colour diffusion transfer type light sensitive photographic material.

(1) An image receiving layer comprising methyl-tri-n-dodecylammonium-p-toluene sulfonate (0.24 g/$m^2$), N-n-hexadecyl-N-morpholinium ethosulfate (1.62 g/$m^2$) and gelatine (8 g/$m^2$)

(2) A light reflecting layer comprising $TiO_2$ (32.46 g/$m^2$) and gelatine (3.246 g/$m^2$)

(3) An opaque scavenger intermediate layer comprising 1-hydroxy-N-[α-(2,4-di-tert-amylphenoxy)butyl]-2-naphthoamide (1.08 g/$m^2$), gelatine (3.90 g/$m^2$), tricresyl phosphate (0.54 g/$m^2$) and carbon black (3.246 g/$m^2$)

(4) A red sensitive gelatine-internal latent image type silver bromide emulsion (1.30 g/$m^2$ of gelatine and 1.08 g/$m^2$ of silver), a cyan DDR coupler, 1-hydroxy-4-{4-[α-(3-pentadecylphenoxy)butylamido]phenoxy}-N-ethyl-3',5'-dicarboxy-2-naphthoanilide (0.81 g/$m^2$), and a foggant, formyl-4-methylhydrazide (0.5 g per mole of silver bromide).

(5) A scavenger intermediate layer comprising 1-hydroxy-N-[α-(2,4-di-tert-amylphenoxy)butyl]-2-naphthoamide (0.49 g/$m^2$), tricresyl phosphate (0.24 g/$m^2$) and gelatine (0.7 g/$m^2$)

(6) A green sensitive gelatine-internal latent image type silver bromide emulsion (0.68 g/$m^2$ of gelatine and 0.76 g/$m^2$ of silver), an internally fogged emulsion (0.29 g/$m^2$ of gelatine and 0.22 g/$m^2$ of silver), a magenta DDR coupler, 1-phenyl-3-(3,5-disulfobenzamido)-4-(6-hydroxy-4-pentadecylphenylazo)-5-pyrazolone dipotassium salt (0.81 g/$m^2$), and a foggant, formyl-4-methylphenylhydrazide (0.35 g per mol of silver bromide)

(7) A scavenger and yellow filter layer comprising 1-hydroxy-N-[α-(2,4-di-tert-amylphenoxy)butyl]-2-naphthoamide (0.49 g/$m^2$), tricresyl phosphate (0.24 g/$m^2$), a yellow Carey-Lea silver (0.11 g/$m^2$) and gelatine (0.70 g/$m^2$)

(8) A blue sensitive gelatine-internal latent image type silver bromide emulsion (1.08 g/$m^2$ of gelatine and 1.08 g/$m^2$ of silver), a yellow DDR coupler, α-pivalyl-α-[4-(N-methyl-n-octadecylsulfamyl)phenoxy]-4-sulfoacetoanilide potassium salt (1.30 g/$m^2$), and a foggant, formly-4-methylphenylhydrazide (0.5 g per mole of silver bromide).

(9) A protecting layer of gelatine (0.54 g/$m^2$)

The light sensitive photographic material having the above construction was exposed through an optical wedge, and then developed with the following developing solution.

Composition of the developing solution

Water: 100 ml

Benzyl alcohol: 0.5 ml
Piperidinohexose reductone: 0.025 g
5-Nitrobenzimidazole: 0.005 g
Sodium hydroxide: 1.25 g
4-Amino-N-ethyl-N-β-hydroxyethylaniline: 1.5 g
Hydroxyethyl cellulose: 2.5 g The treatment with the above developing solution was carried out by diffusing the developing solution between a layer containing polyacrylic acid prepared separately from the exposed surface of the light sensitive material having the above construction and the opaque polyethylene terephthalate film support having a polyvinyl acetate timing layer, which were arranged to face to face.

After the treatment, the light sensitive photographic material was observed from the side of the transparent film support, whereby a colour image corresponding to the exposure was observed.

On the other hand, among the above mentioned constituting layers of the photographic material, the composition of the green sensitive layer indicated at (6) was modified to have a composition comprising a green sensitive gelatine-internal latent image type silver bromide emulsion (0.97 g/m$^2$ of gelatine and 1.10 g/m$^2$ of silver), a magenta DDR coupler (same as the above (6)) (0.81 g/m$^2$), and a foggant (same as the foggant of the above (6)) (0.5 g per mol of silver bromide). The light sensitive photographic material thus modified was exposed and developed in the same manner as above, and a colour image was obtained. This colour image was compared with the colour image obtained by the foregoing material. It was found that the colour image obtained by the foregoing material had a maximum density higher by about 0.20 and a minimum density lower by about 0.05 than the colour image obtained by the modified material. From this experiment, it has been found that even through the colour diffusion transfer type light sensitive photographic material of the present invention has a less amount of the coated silver, the colour image thereby obtained has a high maximum density and a low minimum density.

EXAMPLE 4

Colour Diffusion Transfer Type Light Sensitive Photographic Material

The following layers were successively applied onto a transparent polyethylene terephthalate film support to obtain a multi-layer colour diffusion transfer type light sensitive photographic material.

(1) An image receiving layer comprising a terpolymer composed of styrene, N-vinylbenzyl-N-benzyl-N,N-dimethyl ammonium chloride and divinylbenzene (49:49:2 in molar ratio) (22 mg/100 cm$^2$), and gelatine (22 mg/100 cm$^2$)

(2) A light reflecting layer comprising titanium dioxide (220 mg/100 cm$^2$) and gelatine (22 mg/100 cm$^2$)

(3) A black opaque layer comprising carbon black (25 mg/100 cm$^2$), and gelatine (17 mg/100 cm$^2$)

(4) A layer comprising the following magenta RDR compound (7.0 mg/100 cm$^2$), N,N-diethyl lauramide (7.0 mg/100 cm$^2$), and gelatine (17 mg/100 cm$^2$)

Magenta RDR compound

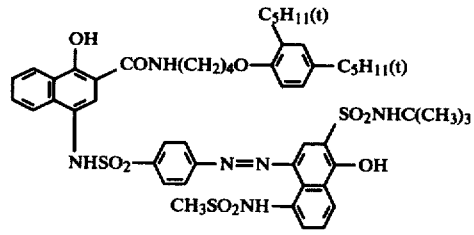

(5) A green sensitive internal latent image type silver bromide emulsion layer comprising the same green sensitive internal latent image type silver bromide emulsion as used in Example 3 (14.0 mg/100 cm$^2$ of silver), 2-sec-octadecylhydroquinone-5-potassium sulfonate (1.0 mg/100 cm$^2$), 1-[4-(2-formylhydrazino)phenyl]-3-phenylthiourea (2 mg per mol of silver bromide), and gelatine (17 mg/100 cm$^2$)

(6) A protecting layer comprising tetrakis (vinylsulfonylmethyl) methane (0.8 mg/100 cm$^2$), 2,5-di-tert-octylhydroquinone (6 mg/100 cm$^2$), dibutyl phthalate (2 mg/100 cm$^2$) and gelatine (10.0 mg/100 cm$^2$)

Further, modified green sensitive emulsions were prepared by reducing the amount of the green sensitive internal latent image type silver bromide emulsion of the layer indicated at (5) in the above light sensitive photographic material, as shown in the following Table 3 or by supplementing the internally fogged emulsion of Example 3 in an amount corresponding to the reduction of the amount of the green sensitive internal latent image type silver bromide. In these cases, the total amounts of silver halide coated on the film supports were controlled to be constant at 14.0 mg/100 cm$^2$ as calculated on the basis of the amount of silver. Further, the amount of 1-[4-(2-formylhydrazino)phenyl]-3-phenylthiourea was varied in proportion to the amount of the internal latent image type silver bromide emulsion. Then, the following layers were successively applied onto a transparent polyethylene terephthalate film support having a thickness of 100 μm to obtain a cover sheet.

(a) A neutralizing layer comprising a co-polymer composed of acrylic acid and butyl acrylate (70:30 in molar ratio) (200 mg/100 cm$^2$)

(b) A timing layer comprising cellulose diacetate (acetylation degree: 55 molar %) (57 mg/100 cm$^2$)

Each of the light sensitive photographic materials thus prepared, was exposed to a minus blue light through an optical wedge, and the above mentioned cover sheet was overlaid on the exposed surface of the light sensitive photographic material and a pod containing an alkaline treating solution having the following composition was attached inbetween. The combined structure was passed through a pair of pressure rollers to rupture the pod, whereupon the above mentioned alkaline treating solution was diffused between the exposed surface of the light sensitive photographic material and the timing layer of the cover sheet. The thickness of the treating solution layer was controlled to be 80 μm.

Composition of the treating solution

Potassium hydroxide: 70.125 g

4-Hydroxymethyl-4-methyl-1-phenyl-3-pyrazolidone: 12.615 g
5-Methylbenzotriazole: 4.125 g
Carbon black: 160 g
Sodium carboxymethyl cellulose: 60.0 g
Water: 1000 ml When the treated photographic materials were observed from the side of the image receiving layer, it was seen that magenta dye images corresponding to the exposures were formed.

As apparent from the following Table 3, the light sensitive photographic materials (Nos. 4 and 5) containing the internal latent image type silver bromide emulsion and a so-called internally fogged emulsion having fog centers in the same layer, according to the present invention, produce colour images having a distinctively higher maximum density and a lower minimum density than the light sensitive photographic materials (Nos. 1 to 3) wherein the internal latent image type silver bromide emulsion was used alone.

TABLE 3

| No. | Relative amounts of the internal latent image type emulsions | Relative amounts of the internally fogged emulsions | Dmax | Dmin | Relative sensitivities |
|---|---|---|---|---|---|
| 1 | 1.0 | — | 1.61 | 0.17 | 100 |
| 2 | 0.8 | — | 1.50 | 0.15 | 95 |
| 3 | 0.6 | — | 1.38 | 0.14 | 92 |
| 4 | 0.8 | 0.2 | 1.80 | 0.15 | 96 |
| 5 | 0.6 | 0.4 | 1.65 | 0.14 | 97 |

EXAMPLE 5

Colour Diffusion Transfer Type Light Sensitive Photographic Material

The following colour diffusion transfer type light sensitive photographic material was prepared with use of the same green sensitive internal latent image type silver bromide emulsion as used in Example 4 and the same internally fogged emulsion as used in Example 3. Namely, a colour diffusion transfer type light sensitive photographic material having the same constituting layers as in Example 4 was prepared except that among constituting layers (1) to (6), the layer (4) was modified as described below.

A layer comprising the magenta RDR compound (7.0 mg/100 $cm^2$) used in Example 4, as the dye image forming substance, N,N-diethyl lauramide (7.0 mg/100 $cm^2$), gelatine (17 mg/100 $cm^2$) and an internally fogged emulsion as shown in the following Table 4, was prepared, and the layer thus obtained was combined with other layers to form a multi-layer structure of a colour diffusion transfer type light sensitive photographic material.

The light sensitive photographic material thus prepared was subjected to the exposure and development treatments in the same manner as in Example 4, whereupon a transferred image of a magenta dye image was obtained.

Table 4 clearly shows the effect of the present invention where the internally fogged emulsion and the RDR compound as the dye image forming substance were incorporated in the same layer. Namely, in the light sensitive photographic materials (Nos. 2 to 4) wherein the internally fogged emulsion and the RDR compound were incorporated in the same layer, it was observed that the colour images thereby obtained had an increased maximum density and a decreased minimum density and the sensitivity was slightly increased. From the measurement of the developed silver amount, a decrease in the amount of silver was observed with the light sensitive photographic materials (Nos. 2 to 4) according to the present invention.

TABLE 4

| No. | Relative amounts of the internally fogged emulsions | Relative sensitivities | Dmax | Dmin | Amounts of the developed silver |
|---|---|---|---|---|---|
| 1 | — | 100 | 1.45 | 0.17 | 52 |
| 2 | 0.1 | 103 | 1.56 | 0.16 | 45 |
| 3 | 0.2 | 101 | 1.61 | 0.15 | 38 |
| 4 | 0.4 | 103 | 1.72 | 0.16 | 33 |

In the above Table, the relative amounts of the internally fogged emulsions were represented by molar ratios relative to the unfogged internal latent image type silver bromide emulsion, and the amount of the developed silver was represented by a proportion (percentage) relative to the amount of the coated silver.

What is claimed is:

1. A direct positive type light sensitive silver halide photographic material which comprises, on said support, at least one layer containing an unfogged internal latent image type silver halide emulsion which, when applied onto a test piece, exposed for from 1/100 to 1 second, and developed for 3 minutes at 20° C. in an internal developing solution, produces an image having a maximum density of at least 5 times higher than the maximum density obtainable by the development for 4 minutes at 20° C. in a surface developing solution, said internal developing solution having the following composition
hydroquinone: 15 g
monomethyl-p-aminophenol sulfate: 15 g
sodium sulfite (anhydride): 50 g
potassium bromide: 10 g
sodium hydroxide: 25 g
sodium thiosulfate (crystals): 20 g
water: to bring the solution to one liter,
and said surface developing solution having the following composition
p-hydroxy phenylglycine: 10 g
sodium carbonate (crystals): 100 g
water: to bring the solution to one liter; and an internal latent image type silver halide emulsion having fog centers in silver halide grains which, when applied onto a test piece, exposed for from 1/100 to 1 second and developed for 3 minutes at 20° C. in said internal developing solution, produces an image having a maximum density of at least 10 times higher than the maximum density obtainable by the development for 4 minutes at 20° C. in said surface developing solution, and has a degree of fogging such that when a sample composed of a transparent support comprising a polyethylene terephthalate film coated with the emulsion having fog centers in an amount of from 3.5 to 4.5 g/$m^2$ as the amount of silver, and developed in said internal developing solution at 20° C. for 3 minutes, the transmission density will be at least 0.50;

the proportion of the unfogged internal latent image type silver halide emulsion to the internal latent image type silver halide emulsion having fog centers in silver halide grains is from 10:0.03 to 10:30 in a molar ratio based on silver halide;

said internal latent image type silver halide emulsion having fog centers in silver halide grains is incorporated (i) in said layer containing said unfogged internal latent image type silver halide emulsion or (ii) in another layer of said photographic material when said photographic material comprises more than two layers.

2. A direct positive type light sensitive silver halide photographic material as claimed in claim 1, wherein the internal latent image type silver halide emulsion having fog centers in silver halide grains, is incorporated in the layer containing unfogged internal latent image type silver halide emulsion.

3. A direct positive type light sensitive silver halide photographic material as claimed in claim 1, wherein the internal latent image type silver halide emulsion having fog centers in silver halide grains, is incorporated in a constituent layer of the photographic material other than the layer containing unfogged internal latent image type silver halide emulsion.

4. A direct positive type light sensitive silver halide photographic material as claimed in claim 1, wherein the unfogged internal latent image type silver halide emulsion is composed mainly of silver bromide and comprises silver halide grains having a core/shell structure composed of a chemically sensitized silver halide core and silver halide coated thereon, and the surface of the silver halide grains is chemically sensitized.

5. A direct positive type light sensitive silver halide photographic material as claimed in claim 1, wherein the unfogged internal latent image type silver halide emulsion is composed of pure silver bromide grains having a core/shell structure, and the average grain size is within a range of from 0.3 to 3.0 μm.

6. A direct positive type light sensitive silver halide photographic material as claimed in claim 1, wherein the unfogged internal latent image type silver halide emulsion is composed mainly of silver bromide grains having a core/shell structure and the shell portion contains from 0.05 to 10 molar % of silver iodide.

7. A direct positive type light sensitive silver halide photographic material as claimed in claim 1, wherein the unfogged internal latent image type silver halide emulsion comprises silver halide grains having a grain size within a range of from 0.5 to 3.0 μm.

8. A direct positive type light sensitive silver halide photographic material as claimed in claim 1, wherein the internal latent image type silver halide emulsion having fog centers in silver halide grains, comprises internally fogged silver halide grains, and is an emulsion which, when applied onto a transparent support in an amount of from 3.5 to 4.5 g/m$^2$ as evaluated as the amount of silver and developed for 3 minutes at 20° C. with an internal developing solution, presents a transmission density of at least 0.50.

9. A direct positive type light sensitive silver halide photographic material as claimed in claim 1, wherein the internal latent image type silver halide emulsion having fog centers in silver halide grains, comprises silver halide grains having a grain size within a range of from 0.15 to 3.0 μm.

10. A direct positive type light sensitive silver halide photographic material as claimed in claim 1, wherein the internal latent image type silver halide emulsion having fog centers in silver halide grains, comprises silver halide grains having a core/shell structure composed of silver halide having, on its surface, a fogged center and unfogged silver halide coated thereon.

11. A direct positive type light sensitive silver halide photographic material as claimed in claim 10, wherein the average thickness of the shell of the core/shell structure is from 0.05 to 0.30 μm.

12. A direct positive type light sensitive silver halide photographic material as claimed in claim 1, wherein the internal latent image type silver halide emulsion having fog centers in silver halide grains, is composed of silver chloride grains.

13. A direct positive type light sensitive silver halide photographic material as claimed in claim 1, wherein the internal latent image type silver halide emulsion having fog centers in silver halide grains, is composed of silver bromide grains.

14. A direct positive type light sensitive silver halide photographic material as claimed in claim 1, wherein the internal latent image type silver halide emulsion having fog centers in silver halide grains, is composed of silver iodobromide and the iodide content is at most 10 molar %.

15. A direct positive type light sensitive silver halide photographic material as claimed in claim 1, wherein the average grain size of the silver halide grains of the internal latent image type silver halide emulsion having fog centers in silver halide grains, does not exceed the average grain size of the silver halide grains of the unfogged internal latent image type silver halide emulsion.

16. A direct positive type light sensitive silver halide photographic material as claimed in claim 1 which further comprises the combination with a dye image forming substance being incorporated in said layer, or either in said layer or in another constituent layer when said photographic material comprises more than two layers to provide a colour diffusion transfer type light sensitive photographic material.

17. A colour diffusion transfer type light sensitive photographic material as claimed in claim 16, wherein the internal latent image type silver halide emulsion having fog centers in silver halide grains, is incorporated in the unfogged internal latent image type silver halide emulsion layer.

18. A colour diffusion transfer type light sensitive photographic material as claimed in claim 16, wherein the internal latent image type silver halide emulsion having fog centers in silver halide grains, is incorporated in a constituent layer of the photographic material other than the unfogged internal latent image type silver halide emulsion layer.

19. A colour diffusion transfer type light sensitive photographic material as claimed in claim 16, wherein the dye image forming substance is a diffusible dye releasing coupler.

20. A colour diffusion transfer type light sensitive photographic material as claimed in claim 16, wherein the dye image forming substance is a redox dye releasing compound.

21. A colour diffusion transfer type light sensitive photographic material as claimed in claim 16, wherein the unfogged internal latent image type silver halide emulsion is composed mainly of silver bromide and comprises silver halide grains having a core/shell structure composed of a chemically sensitized silver halide core and silver halide coated thereon, and the surface of the silver halide grains is chemically sensitized.

22. A colour diffusion transfer type light sensitive photographic material as claimed in claim 16, wherein the unfogged internal latent image type silver halide emulsion is composed of pure silver bromide grains having a core/shell structure, and the average grain size is within a range of from 0.3 to 3.0 μm.

23. A colour diffusion transfer type light sensitive photographic material as claimed in claim 16, wherein the unfogged internal latent image type silver halide emulsion is composed mainly of silver bromide grains having a core/shell structure and the shell portion contains from 0.05 to 10 molar % of silver iodide.

24. A colour diffusion transfer type light sensitive photographic material as claimed in claim 16, wherein the unfogged internal latent image type silver halide emulsion comprises silver halide grains having a grain size within a range of from 0.5 to 3.5 μm.

25. A colour diffusion transfer type light sensitive photographic material as claimed in claim 16, wherein the internal latent image type silver halide emulsion having fog centers in silver halide grains, comprises silver halide grains having a grain size with a range of from 0.15 to 3.0 μm.

26. A colour diffusion transfer type light sensitive photographic material as claimed in claim 16, wherein the internal latent image type silver halide emulsion having fog centers in silver halide grains, comprises silver halide grains having a core/shell structure composed of silver halide having, on its surface, a fogged center and unfogged silver halide coated thereon.

27. A colour diffusion transfer type light sensitive photographic material as claimed in claim 26, wherein the average thickness of the shell of the core/shell structure is from 0.02 to 0.30 μm.

28. A colour diffusion transfer type light sensitive photographic material as claimed in claim 16, the internal latent image type silver halide emulsion having fog centers in silver halide grains, is composed of silver chloride grains.

29. A colour diffusion transfer type light sensitive photographic material as claimed in claim 16, wherein the internal latent image type silver halide emulsion having fog centers in silver halide grains, is composed of silver bromide grains.

30. A colour diffusion transfer type light sensitive photographic material as claimed in claim 16, wherein the internal latent image type silver halide emulsion having fog centers in silver halide grains, is composed of silver iodobromide and the iodide content is at most 10 molar %.

31. A colour diffusion transfer type light sensitive photographic material as claimed in claim 16, wherein the average grain size of the silver halide grains of the internal latent image type silver halide emulsion having fog centers in silver halide grains, does not exceed the average grain size of the silver halide grains of the unfogged internal latent image type silver halide emulsion.

32. A colour diffusion transfer type light sensitive photographic material as claimed in claim 19, wherein the diffusible dye releasing coupler is incorporated in the same layer as the internal latent image type silver halide emulsion having fogged centers in silver halide grains.

33. A colour diffusion transfer type light sensitive photographic material as claimed in claim 20, wherein a non-diffusible redox dye releasing compound is incorporated in the same layer as the internal latent image type silver halide emulsion having fog centers in silver halide grains.

34. A colour diffusion transfer type light sensitive photographic material as claimed in claim 19, wherein the diffusible dye releasing coupler is represented by the following general formula I or II:

DYE-LINK-COUP-BALL I

BALL-LINK-(COUP)′ II where DYE represents a diffusible dye group or its precusor group, LINK represents a bivalent connecting group selected from the group consisting of —O—, —S—, —N=N—, and —$SO_2$NH— (provided that the nitrogen atom is bonded to COUP or (COUP)′), COUP represents a coupler group selected from the group consisting of 5-pyrazolone couplers, phenol couplers, naphthol couplers, open-chained keto methylene couplers, indanone couplers and cyclopentanone couplers, and (COUP)′ represents a coupler group selected from the group consisting of 5-pyrazolone couplers, phenol couplers, naphthol couplers, and open-chained keto methylene couplers (provided each of the COUP and (COUP)′ is connected to the LINK at the coupling position), and BALL represents a photographically inactive ballast group having a molecular size and/or conformation capable of maintaining the non-diffusible dye image forming substance represented by the general formula I or II to be non-diffusible under an alkaline condition.

35. A colour diffusion transfer type light sensitive photographic material as claimed in claim 20, wherein the non-diffusible redox dye releasing compound is represented by the following general formula III:

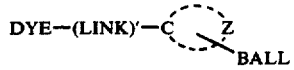

III where (LINK)′ represents —O—, —S—, —$SO_2$— or —$SO_2$NH— (provided the nitrogen atom is bonded to

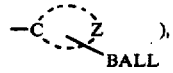

Z represents a group of non-metallic atoms required to form a 5- or 6-member ring which is capable of being separated together with the carbon atom linked to the (LINK)′ from the (LINK)′ under an alkaline condition by the oxidation-reduction reaction with an oxidation product of a silver halide developing agent, DYE represents a diffusible dye group or its precusor group and BALL represents a photographically inactive ballast group having a molecular size and/or conformation capable of maintaining the non-diffusible dye image forming substance to be non-diffusible under an alkaline condition.

36. A colour diffusion transfer type light sensitive photographic material as claimed in claim 35, wherein

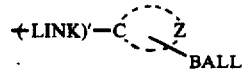

is represented by the following general formula IIIa:

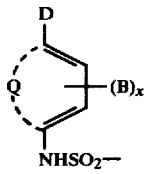

IIIa where Q represents a group of non-metallic atoms required to form a 6-member aromatic ring, B represents a halogen atom, a sulfo group, a carboxyl group, an alkyl group, an aryl group, an alkoxy group, an aryloxy group, a nitro group, an amino group, a cyano group, an alkylamino group, an arylamino group, an alkylthio group or a heterocyclic group, which is directly or via

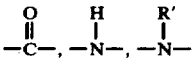

(where R' is an alkyl group), an alkylene group, —O—, —S—, —$SO_2$—, a phenylene group or an optional combination thereof, attached to said 6-member aromatic ring formed by the above Q, D represents a group represented by —$OR^{(1)}$ or —$NHR^{(2)}$ where $R^{(1)}$ represents a hydrogen atom or a group which can be split from the oxygen atom under a condition of a hydroxyl ion concentration being from $10^{-5}$ to 2 mol/l, and $R^{(2)}$ represents a hydrogen atom or an alkyl group, x represents an integer of 1, 2 or 3 and when x is 2 or 3, B may be the same or different groups, and a total number of carbon atoms in $(B)_x$ and the alkyl group of $R^{(2)}$ is at least 8.

37. A colour diffusion transfer type light sensitive photographic material as claimed in claim 35, wherein

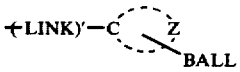

is represented by the following general formula IIIb:

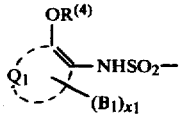

IIIb where $Q_1$ represents a group of non-metallic atoms required to form a 6-member aromatic ring, $B_1$ represents a halogen atom, a sulfo group, a carboxyl group, an alkyl group, an aryl group, an alkoxy group, an aryloxy group, a nitro group, an amino group, a cyano group, an alkylamino group, an arylamino group, an alkylthio group or a heterocyclic group, which is directly or via

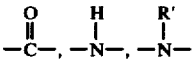

(where R' is an alkyl group), an alkylene group, —O—, —S—, —$SO_2$—, a phenylene group or an optional combination thereof, attached to said 6-member aromatic ring formed by the above Q, $R^{(4)}$ represents a hydrogen atom or a group which can be split from the oxygen atom under a condition of a hydroxyl ion concentration being from $10^{-5}$ to 2 mol/l, $x_1$ represents an integer of 1, 2 or 3 and when $x_1$ is 2 or 3, $B_1$ may be the same or different groups, and a total number of carbon atoms in $(B_1)_{x1}$ is at least 8.

38. A colour diffusion transfer type light sensitive photographic material as claimed in claim 35, wherein

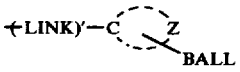

is represented by the following general formula IIIc:

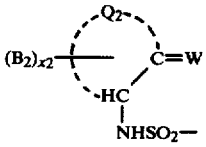

IIIc where W is an oxygen atom or =$NR^{(5)}$ (where $R^{(5)}$ represents a hydroxyl group or an amino group which may have a substituent), $Q_2$ represents a group of non-metallic atoms required to form together with the carbon atom a 5- or 6-member saturated or unsaturated non-aromatic hydrocarbon ring, $B_2$ represents a halogen atom, a sulfo group, a carboxyl group, an alkyl group, an aryl group, an alkoxy group, an aryloxy group, a nitro group, an amino group, a cyano group, an alkylamino group, an arylamino group, an alkylthio group or a heterocyclic group, which is directly or via

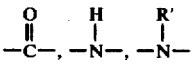

(where R' is an alkyl group), an alkylene group, —O—, —S—, —$SO_2$—, a phenylene group or an optional combination thereof, attached to the 5- or 6-membered non-aromatic ring formed by the above $Q_2$. $x_2$ is an integer of 1, 2 or 3 and when $x_2$ is 2 or 3, $B_2$ may be the same or different groups, and a total number of carbon atoms in $(B_2)_{x2}$ is at least 8.

39. A colour diffusion transfer type light sensitive photographic material as claimed in claim 35, wherein

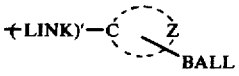

is represented by the following general formula IIIe:

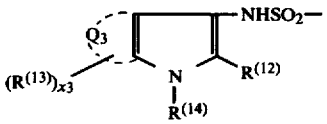

IIIe where $Q_3$ represents a group of non-metallic atoms required to form a 5- or 6-member ring, $R^{(12)}$ represents a hydrogen atom, a halogen atom, a hydroxyl group, a cyano group, an amino group, an alkyl group, an aryl group, an acyl group, a carbamoyl group, a carbamido group, an alkoxycarbamoyl group or a heterocyclic group, $R^{(13)}$ represents a hydrogen atom, a halogen atom, a hydroxyl group, a cyano group, a sulfo group, a carboxyl group, an alkyl group, an aryl group, an alkoxy group, an acyl group, an amino group, a carbamido group or an acyloxy group, $R^{(14)}$ represents a hydrogen atom, an alkyl group, an aryl group or a heterocyclic group, $x_3$ represents an integer of from 1 to 4 and when $x_3$ is from 2 to 4, $R^{(3)}$ may be the same or different groups, $R^{(14)}$ may form together with $R^{(12)}$ and/or $R^{(13)}$ a 5- or 6-member hetero ring, and a total number of carbon atoms in $R^{(12)}$, $R^{(13)}$ and $R^{(14)}$ is at least 8.

* * * * *